United States Patent [19]

Huelster

[11] Patent Number: 4,901,523

[45] Date of Patent: Feb. 20, 1990

[54] ROTOR FOR GAS TURBINE ENGINE

[75] Inventor: David S. Huelster, Indianapolis, Ind.

[73] Assignee: General Motors Corporation, Detroit, Mich.

[21] Appl. No.: 294,442

[22] Filed: Jan. 9, 1989

[51] Int. Cl.[4] ..... F02C 3/00; F02C 7/00

[52] U.S. Cl. ..... 60/39.161; 60/39.75; 416/198 A

[58] Field of Search ..... 60/39.15, 39.161, 39.31, 60/39.32, 39.75; 29/464; 416/198 A; 403/367, 409.1

[56] References Cited

U.S. PATENT DOCUMENTS

| | | | |
|---|---|---|---|
| D. 272,392 | 1/1984 | Bigelow | D8/354 |
| 2,762,559 | 9/1956 | Faught | 416/198 A |
| 2,846,847 | 8/1958 | Simmons | 60/39.32 |
| 2,977,758 | 4/1961 | Haworth et al. | 60/39.75 |
| 3,007,312 | 11/1961 | Shutts | 60/39.32 |
| 3,083,947 | 4/1963 | Horrocks | 416/198 A |
| 3,269,677 | 8/1966 | Stoeckly | 60/39.31 |
| 3,285,568 | 11/1966 | Biach | 254/29 A |
| 3,526,092 | 9/1970 | Steel | 60/39.161 |
| 3,527,053 | 9/1970 | Horn | 60/39.75 |
| 3,597,110 | 8/1971 | Corsmeier | 416/198 A |
| 3,688,371 | 9/1972 | Koff | 416/198 A |
| 3,770,994 | 11/1973 | Smith | 384/583 |
| 3,967,919 | 7/1976 | Coulon et al. | 416/198 A |
| 4,037,680 | 7/1977 | Grove | 180/254 |
| 4,380,405 | 9/1983 | Kaneki | 403/409.1 |
| 4,558,564 | 12/1985 | Bouiller et al. | 60/39.161 |
| 4,664,599 | 5/1987 | Robbins et al. | 416/198 A |
| 4,734,009 | 3/1988 | Campbell et al. | 384/273 |
| 4,737,076 | 4/1988 | Bonner et al. | 416/198 A |
| 4,775,260 | 10/1988 | Kermer | 403/409.1 |

*Primary Examiner*—Louis J. Casaregola
*Assistant Examiner*—Timothy S. Thorpe
*Attorney, Agent, or Firm*—Saul Schwartz

[57] ABSTRACT

A gas turbine engine rotor having a turbine on a tubular shaft of the rotor and a compressor rotating group adapted for attachment to the shaft. The shaft has a radial flange at one end with an annular face in a plane perpendicular to the axis of the shaft and interrupted by a symmetrical array of bolt holes. The compressor rotating group has an annular face juxtaposed the annular face on the shaft and interrupted by a corresponding symmetrical array of bolt holes. An adjustable annular shim pack consisting of a pair of identical wedge-shaped annular shims is disposed between the juxtaposed annular faces and is adjusted by relatively rotating the shims until the wedge angle of the shim pack equals the angle between the planes of the annular faces when the longitudinal axes of the shaft and compressor rotating group are collinear. The compressor rotating group is bolted to the shaft with the shim pack captured between the juxtaposed annular faces.

3 Claims, 3 Drawing Sheets

ROTOR FOR GAS TURBINE ENGINE

This invention was made under a contract or subcontract of the United States Department of Defense.

FIELD OF THE INVENTION

This invention relates to rotors for gas turbine engines.

BACKGROUND OF THE INVENTION

In many gas turbine engines, efficiency is promoted by minimizing running clearances between seals on a case of the engine and the blade tips of compressor blades and turbine blades on a gasifier rotor of the engine. One way such clearances are minimized is by rigorous control of the assembled dimensions of the gasifier rotor. For example, in a gasifier rotor where the turbine is mounted on one or more mounting pilots of a gasifier shaft bolted to the rotating group of a compressor, manufacturing tolerance stack-up may render it necessary to custom grind the mounting pilots to achieve required assembled dimensions. A gas turbine engine rotor according to this invention incorporates an adjustable shim pack which obviates the need for custom grinding of the mounting pilots.

SUMMARY

This invention is a new and improved gas turbine engine rotor particularly suited for gasifier applications and including a compressor rotating group, a turbine, and a tubular gasifier shaft therebetween. In the rotor according to this invention, the gasifier shaft has a pair of exterior or outside mounting pilots which are closely received within a tubular hub of the turbine. The gasifier shaft has a radial attaching flange with an annular face in a plane perpendicular to the longitudinal axis of the shaft, the annular face being interrupted by a symmetrical array of bolt holes. The compressor rotating group has a corresponding annular face in a plane perpendicular to its longitudinal axis interrupted by a corresponding symmetrical array of bolt holes. An adjustable annular shim pack is captured between the annular faces on the compressor rotating group and the gasifier shaft and includes identical first and second wedge-shaped annular shims. The shims are rotatably indexable relative to each other such that the wedge angle of the shim pack is variable from zero when the shims are at wedge opposite relative positions to a maximum in wedge aligned relative positions of the shims, the maximum wedge angle being two times the wedge angle of the individual shims. The shim pack is adjusted to a wedge angle which matches the angle between the planes of the annular faces on the compressor rotating group and the gasifier shaft when their respective longitudinal axes are substantially collinear so that the collinearity is maintained after the compressor rotating group is bolted to the gasifier shaft with the shim pack between the juxtaposed annular faces.

DESCRIPTION OF THE PREFERRED EMBODIMENT

Figure 1:
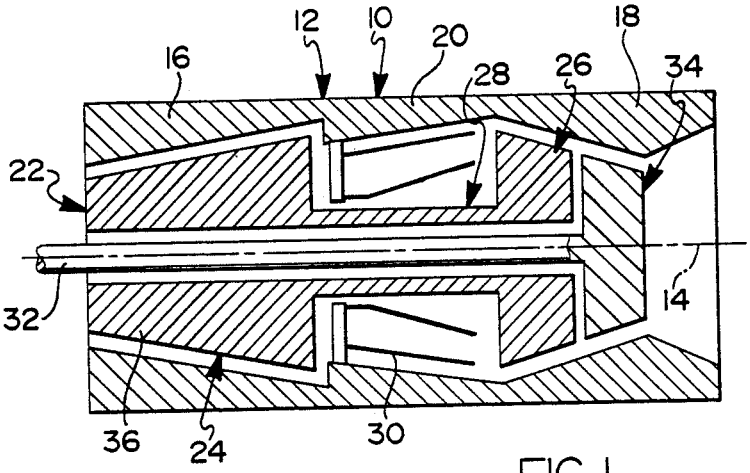
FIG. 1 is a schematic view of a gas turbine engine having a rotor according to this invention.

Referring to FIG. 1, a schematically illustrated gas turbine engine 10 has a case 12 defining a main rotor axis 14 of the engine. The case 12 has a compressor section 16 at the forward end of the engine, a turbine section 18 at the aft end of the engine, and a combustor section 20 between the compressor and combustor sections. A gas generator or gasifier rotor 22 according to this invention is supported on the case 12 for rotation about the axis 14 and includes an axial compressor rotating group 24 in the compressor section 16, a high pressure turbine 26 in the turbine section 18, and a gasifier shaft 28 between the turbine and the compressor. An annular combustor 30 is disposed in the combustor section 20. An output shaft 32 of the engine on the axis 14 is driven independently of the rotor 22 by a low pressure turbine 34 in the turbine section 18 aft of the high pressure turbine.

Figure 2A:
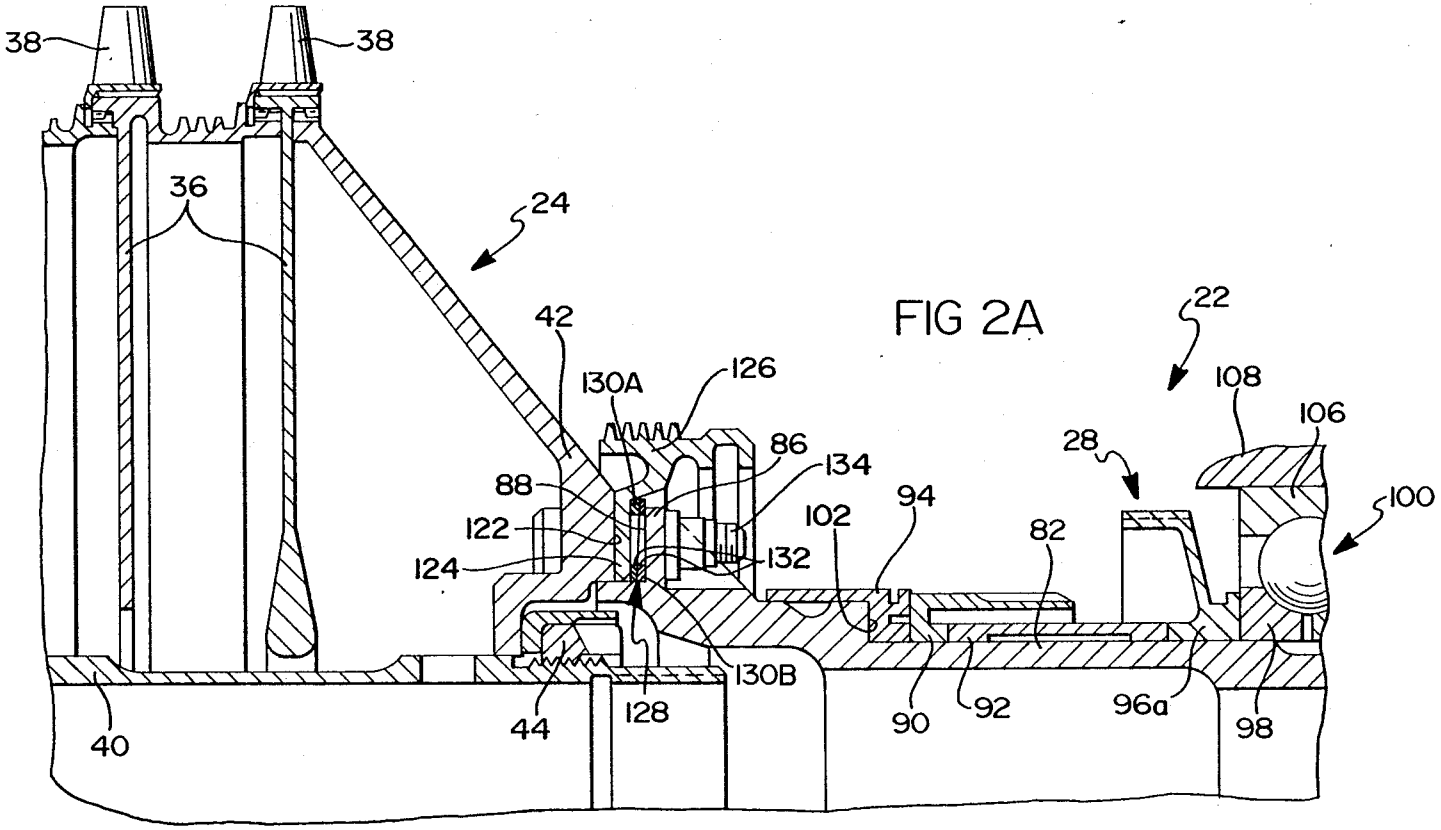
FIGS. 2A and B is a fragmentary sectional view of a physical realization of a gas turbine engine rotor according to this invention.
Figure 2B:
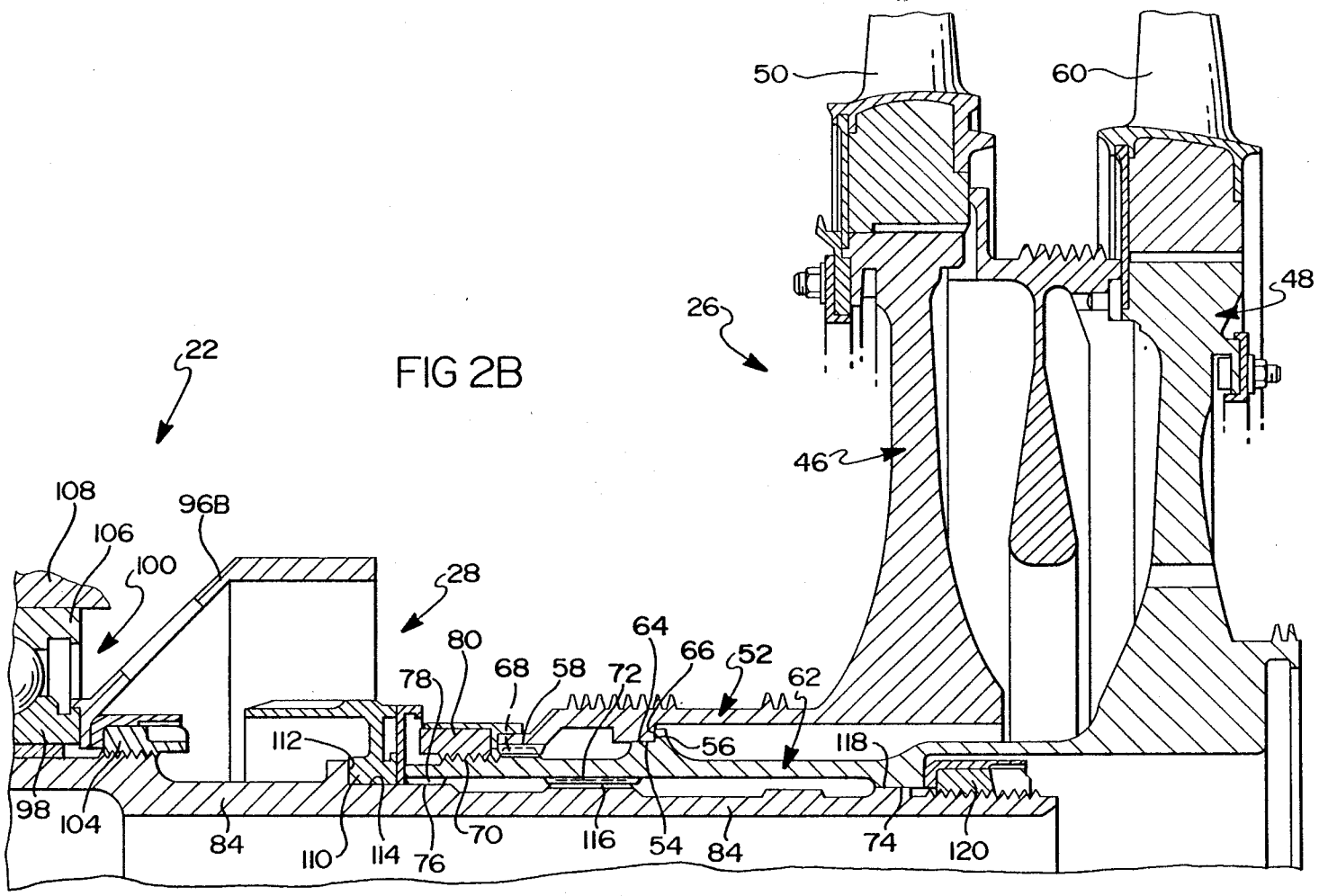

Referring to FIG. 2, which depicts a physical realization of the gasifier rotor 22 according to this invention, the compressor rotating group 24 includes a plurality of conventional compressor wheels 36 which abut near their outer diameters at connections, not illustrated, which assure unitary rotation of the wheels. Each wheel carries a circumferential array of compressor blades 38, the tips of which are located as close as possible to surrounding seals on the case, not shown. The compressor rotating group 24 further includes a tubular center shaft 40 aligned on the longitudinal axis of the rotating group. The center shaft extends through all of the wheels 36 and axially outboard of a hub portion 42 of the aft one of the compressor wheels 36. A nut 44 threaded on the center shaft 40 bears against the outboard side of the hub 42 and clamps the complete stack of compressor wheels 36 against an appropriate abutment, not shown, near the other end of the center shaft whereby the wheels are united to form the compressor rotating group.

The high pressure turbine 26 of the gasifier rotor includes a front or first stage turbine wheel 46 and a back or second stage turbine wheel 48. The first stage wheel 46 has a circumferential array of turbine blades 50 therearound and an integral tubular hub 52. Internally, the hub 52 has a cylindrical pilot diameter or surface 54 adjacent a radial shoulder 56 and a plurality of splines 58 at the mouth of the hub.

The second stage turbine wheel 48 has a circumferential array of turbine blades 60 therearound and an integral tubular hub 62 nested within the hub 52 of the first stage turbine wheel. Externally, the hub 62 has a cylindrical mounting pilot or surface 64 adjacent a radial shoulder 66, a plurality of splines 68 near the forward end of the hub, and a threaded portion 70 forward of the splines 68. Internally, the hub 62 has a plurality of splines 72 and an uninterrupted first internal cylindrical pilot diameter or surface 74 aft of the splines. The diameter of the first internal pilot diameter 74 is smaller than the inside diameter of the splines. Forward of the internal splines 72, the hub 62 has a second internal cylindrical pilot diameter or surface 76 larger than the first pilot diameter 74 and interrupted by a plurality of slots 78 corresponding in number and spacing to the splines 72.

When the hub 62 on the second stage turbine wheel 48 is nested in the hub 52 on the first stage turbine wheel 46, the mounting pilot 64 is closely received in the pilot diameter 54 of the hub 52. Penetration of the hub 62 in the hub 52 is limited by interference between the radial shoulders 56 and 66. Concurrently, the inside splines 58 on the hub 52 mesh with the outside splines 68 on the hub 62 so that the turbine wheels 46 and 48 are coupled for unitary rotation. A nut 80 on threaded portion 70 on the hub 62 captures the first stage turbine wheel 46 on the second stage turbine wheel 48.

With continued reference to FIG. 2, the tubular gasifier shaft 28 has a big diameter portion 82, a small diameter portion 84, and a radial attaching flange 86 at the left or forward end of the big diameter portion. The front side of the radial flange 86 defines an annular face 88 of the flange in a plane generally perpendicular to the longitudinal axis of the shaft. A seal runner 90, a spacer 92, a heat shield 94, a pair of oil slingers 96A-B, and an inner race 98 of a ball bearing 100 are all disposed on the big diameter portion 82 of the gasifier shaft and captured between a radial shoulder 102 on the shaft and a nut 104 threaded onto the shaft at the aft end of the big diameter portion 82. The seal runner 90, spacer 92, heat shield 94, oil slingers 96A-B, and inner race 98 all rotate as a unit with the gasifier shaft. An outer race 106 of the ball bearing 100 is connected to a schematically represented portion 108 of the case 12 of the engine whereby the gasifier shaft is supported on the case for rotation about the main axis 14. When so mounted, the longitudinal axis of the gasifier shaft is collinear with the main axis 14.

A second seal runner 110 is disposed on the gasifier shaft against an annular shoulder 112 thereof. Just aft of the seal runner 110, the small diameter portion 84 of the gasifier shaft has a first cylindrical mounting pilot or surface 114. Aft of the first mounting pilot 114, the gasifier shaft has a plurality of outside splines 116 and, further aft, a second cylindrical mounting pilot or surface 118 smaller than the first mounting pilot 114. Both of the mounting pilots 114 and 118 are centered on the longitudinal axis of the gasifier shaft.

The tubular hub 62 of the second stage wheel 48 is received over the aft end of the gasifier shaft 28 for attachment of the high pressure turbine 26 to the gasifier shaft. The internal pilot diameter 76 on the hub 62 clears the mounting pilot 118 on the gasifier shaft 28 and is indexed relative to the outside splines 116 on the gasifier shaft such that the interruptions or slots 78 in the pilot diameter 76 are aligned with the splines 116. The hub 62 is advanced on the gasifier shaft until the inside pilot diameters 76 and 74 on the hub are concurrently closely received on the mounting pilots 114 and 118, respectively, on the shaft 28. In addition, the inside splines 72 on the hub 62 engage the outside splines 116 on the gasifier shaft 28 whereby the high pressure turbine 26 and the gasifier shaft 28 are connected for unitary rotation. The high pressure turbine 26 and the seal runner 110 are retained on the gasifier shaft by a nut 120 which captures the seal runner and the hub 62 against the shoulder 112 on the shaft.

The annular face 88 on the radial flange 86 of the gasifier shaft is juxtaposed or faces a similar annular face 122 on the hub portion 42 of the aft one of the compressor wheels 36. Each of the annular faces 88 and 122 is interrupted by a plurality of bolt holes, not shown, spaced at equal angular intervals around the faces. A radial annular attaching portion 124 of a seal runner 126 is disposed between the juxtaposed annular faces 88 and 122 and includes a corresponding array of bolt hoes, not shown. An adjustable annular shim pack 128 is disposed between the aft facing side of the attaching portion 124 of the seal runner 126 and the annular face 88 on the radial flange 86 on the gasifier shaft.

Figure 3:
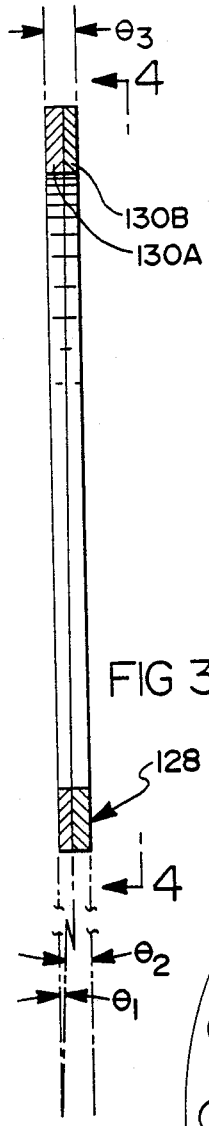
FIG. 3 is an enlarged view of a portion of FIG. 2 showing only the adjustable shim pack.
Figure 4:
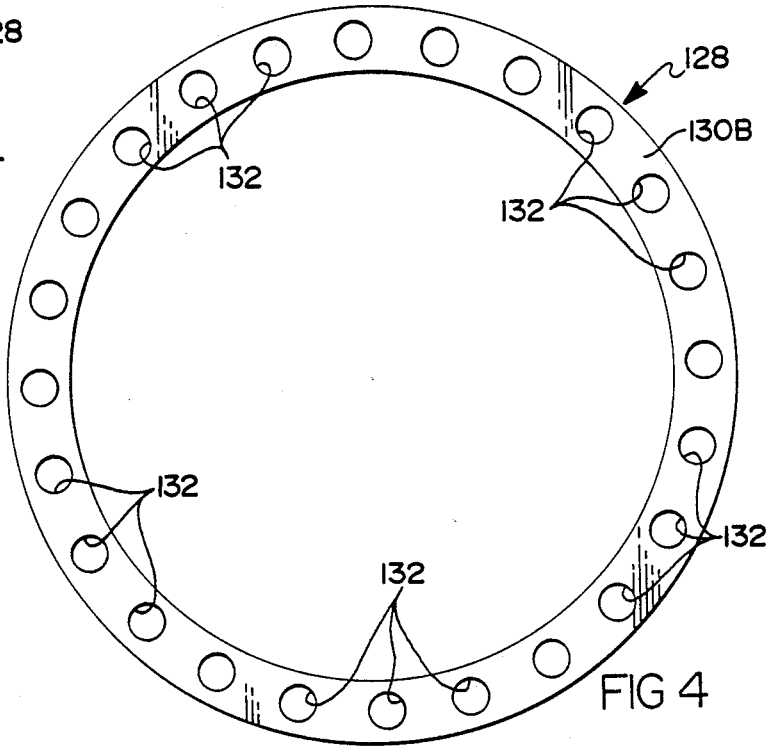
FIG. 4 is a view taken generally along the plane indicated by lines 4—4 in FIG. 3.

As seen best in FIGS. 3–4, the shim pack 128 includes a pair of annular, wedge-shaped shims 130A-B. Each shim has a plurality of bolt holes 132 therein, FIG. 4, corresponding in number and angular spacing to the bolt holes in the annular faces 88 and 122 and in the attaching portion 124 of the seal runner 126. The shim 130A has a wedge angle $\theta_1$ and the shim 130B has a wedge angle $\theta_2$ which is preferably, but not necessarily, the same as the wedge angle $\theta_1$. The shims are angularly indexable through a plurality of positions ranging from wedge opposite relative positions, FIG. 3, characterized by the thickest portions of the shims being diametrically opposite each other, to wedge aligned relative positions, not shown, characterized by the thickest portions of the shims being adjacent each other.

The shim pack 128 has a wedge angle $\theta_3$, FIG. 3, defined by the planes containing the outside surfaces of the shims 130A–B when the inside surfaces of the shims abut each other. Assuming the shims 130A–B are identical, the wedge angle of the shim pack varies in accordance with the relative positions of the shims from a minimum equal to zero, FIG. 3, at the wedge opposite relative positions of the shims to a maximum at the wedge aligned relative positions of the shims equal to the sum of the wedge angles $\theta_1$ and $\theta_2$ of the individual shims. Between the maximum and minimum, the shim pack 128 has a plurality of discrete wedge angles determined by the relative position of the shims when the bolt holes in each are in register.

In the illustrated gasifier rotor, stack-up of manufacturing tolerances in the various elements of the gasifier rotor may contribute to a failure of the longitudinal axis of the compressor rotating group to achieve collinearity with the longitudinal axis of the gasifier shaft within acceptable limits. Such failure manifests itself as an angle between the planes containing the juxtaposed annular faces 88 and 122 when the longitudinal axes of the compressor rotating group and the gasifier shaft are held within the required degree of collinearity. That angle can be relatively easily quantified in terms of both absolute magnitude and angular direction.

During the assembly sequence of an individual gasifier rotor 22, the magnitude and angular direction of the angle between the annular faces 88 and 122 is measured. The shim pack 128 is adjusted by relatively rotating or indexing the shims 130A–B until the shim pack wedge angle $\theta_3$ corresponds exactly or within a predetermined tolerance range to the measured angle between the annular faces. Maintaining the relative positions of the shims 130A–B, the shim pack 128 is rotated until the direction of its wedge angle coincides with the angular direction of the angle between the annular faces 88 and 122. Finally, with the bolt holes 132 in the shims in register and aligned with the bolt holes in the annular faces 88 and 122 and in the attaching portion 124 of the seal runner 126, a plurality of bolts 134 are installed and tightened to rigidly connect the rotating group of the compressor to the gasifier shaft with the shim pack 128 and the attaching portion 124 clamped between the annular faces 88 and 122. The adjusted wedge angle of the shim pack corresponds to, and thus compensates for, the manufacturing tolerance induced angle between the annular faces 88 and 122 so that the longitudinal axes of the compressor rotating group 24 and the gasifier shaft 28 are collinear within predetermined limits. Accordingly, when the gasifier rotor is installed on the case 12 of a gas turbine engine 10, required tip clearances around the compressor and the high pressure turbine blades 38, 50 and 60 are minimized.

It will be apparent to those skilled in this technology that the shim pack 128 may be used directly between the annular faces 88 and 122 without an intervening element such as the attaching portion 124 of the seal runner 126. It will be similarly apparent that the attaching portion 124 of the seal runner could be formed as an annular wedge and thereby replace one of the shims 130A–B. Likewise, fasteners other than bolts 134 could be used to clamp the gasifier shaft to the compressor rotating group so that the shims 88 and 122 could be infinitely adjustable between the aforesaid wedge opposite and wedge aligned relative positions.

The embodiments of the invention in which an exclusive property or privilege is claimed are defined as follows:

1. A gas turbine engine rotor comprising:

a turbine including a bladed turbine wheel having a tubular hub with an internal pilot diameter aligned on a longitudinal axis of said turbine perpendicular to the plane of said bladed turbine wheel, a tubular shaft having a cylindrical outside mounting pilot surface aligned on a longitudinal axis of said shaft closely received in said pilot diameter of said tubular hub when said turbine is disposed on said shaft, means defining a radial flange at one end of said shaft having an annular face in a plane perpendicular to said longitudinal axis of said shaft, a compressor rotating group having a longitudinal axis and an annular face at one end thereof in a plane perpendicular to said longitudinal axis of said compressor rotating group and juxtaposed said annular face on said shaft, an annular adjustable shim pack including a first wedge-shaped annular shim having a first wedge angle and a second wedge-shaped annular shim having a second wedge angle and rotatable relative to said first shim to provide a shim pack wedge angle variable between a minimum at wedge-opposite relative positions of said first and said second annular shims and a maximum at wedge aligned relative positions of said first and said second annular shims, said shim pack being disposed between said juxtaposed annular faces and adjusted to a shim pack wedge angle corresponding to an angle between the planes of said juxtaposed annular faces when said longitudinal axes of said shaft and said compressor rotating group are collinear, and means operative to clamp said compressor rotating group to said shaft with said shim pack captured between said juxtaposed annular faces.

2. The gas turbine engine rotor recited in claim 1 wherein said first wedge-shaped annular shim is identical to said second wedge-shaped annular shim so that said minimum shim pack wedge angle is equal to zero and said maximum shim pack wedge angle is equal to about two times the wedge angle of one of said wedge-shaped annular shims.

3. A gas turbine engine gasifier rotor comprising:

a turbine including a bladed wheel having a tubular hub with an internal pilot diameter aligned on a longitudinal axis of said turbine perpendicular to the plane of said bladed turbine wheel, a tubular gasifier shaft having a cylindrical outside mounting pilot aligned on a longitudinal axis of said gasifier shaft closely received in said pilot diameter of said turbine hub when said turbine is disposed on said gasifier shaft for unitary rotation therewith, means defining a radial flange at one end of said gasifier shaft having an annular face in a plane perpendicular to said gasifier shaft longitudinal axis interrupted by a plurality of bolt holes symmetrically spaced around said annular face, a compressor rotating group having a longitudinal axis and an annular face at one end thereof in a plane perpendicular to said compressor rotating group longitudinal axis interrupted by a plurality of bolt holes corresponding in number and spacing to said bolt holes in said gasifier shaft annular face, said compressor rotating group annular face being juxtaposed said gasifier shaft annular face, a first wedge-shaped annular shim having a predetermined wedge angle and a plurality of bolt holes therein corresponding in number and spacing to said plurality of bolt holes in said gasifier shaft annular face, a second wedge-shaped annular shim identical to said first wedge-shaped annular shim, said first and said second wedge-shaped annular shims being disposed in face-to-face relationship between said juxtaposed annular faces on said compressor rotating group and on said gasifier shaft and defining an annular shim pack adjustable by relative rotation between said first and said second wedge-shaped annular shims through a discrete plurality of relative positions to provide a shim pack wedge angles variable between a minimum equal to zero at wedge-opposite relative positions of said first and said second wedge-shaped annular shims and a maximum equal to two times said predetermined wedge angle at wedge aligned relative positions of said first and said second wedge-shaped annular shims, said shim pack being adjusted to a shim pack wedge angle corresponding to an angle between the planes of said juxtaposed annular faces when said longitudinal axes of said gasifier shaft and said compressor rotating group are collinear, and a plurality of bolts through said bolt holes in said juxtaposed annular faces and in said first and said second wedge-shaped annular shim operative to clamp said compressor rotating groups to said gasifier shaft with said shim pack captured between said juxtaposed annular faces.

* * * * *